US012704084B2

(12) United States Patent
Lee et al.

(10) Patent No.: US 12,704,084 B2
(45) Date of Patent: Aug. 11, 2026

(54) ACOUSTIC METAMATERIAL-BASED MUFFLER FOR EXHAUST NOISE REDUCTION

(71) Applicants: AJOU UNIVERSITY INDUSTRY-ACADEMIC COOPERATION FOUNDATION, Suwon-si (KR); THE CENTER FOR ADVANCED META-MATERIALS, Daejeon (KR)

(72) Inventors: Jin Woo Lee, Suwon-si (KR); Gyeong Ju Lee, Suwon-si (KR)

(73) Assignees: AJOU UNIVERSITY INDUSTRY-ACADEMIC COOPERATION FOUNDATION, Suwon-si (KR); THE CENTER FOR ADVANCED META-MATERIALS, Daejeon (KR)

( * ) Notice: Subject to any disclaimer, the term of this patent is extended or adjusted under 35 U.S.C. 154(b) by 154 days.

(21) Appl. No.: 18/517,295

(22) Filed: Nov. 22, 2023

(65) Prior Publication Data

US 2024/0167403 A1 May 23, 2024

(30) Foreign Application Priority Data

Nov. 22, 2022 (KR) ..... 10-2022-0156857

(51) Int. Cl.
*F01N 1/02* (2006.01)
*F01N 1/08* (2006.01)
*F01N 1/24* (2006.01)

(52) U.S. Cl.
CPC ..... *F01N 1/026* (2013.01); *F01N 1/24* (2013.01); *F01N 1/083* (2013.01)

(58) Field of Classification Search
CPC .. F01N 1/026; F01N 2470/24; F01N 2490/02; F01N 2490/04; F01N 2490/15
(Continued)

(56) References Cited

U.S. PATENT DOCUMENTS 969,225 A * 9/1910 Walstrom ..... F01N 1/166 181/254
1,291,271 A * 1/1919 Tvedt ..... F01N 1/22 181/271

(Continued)

FOREIGN PATENT DOCUMENTS

DE 4327562 A1 * 2/1995 ..... F01N 1/02
JP 7032108 B2 3/2022

(Continued)

OTHER PUBLICATIONS

Kheybari, Majid, and Salman Ebrahimi-Nejad. "Dual-target-frequency-range stop-band acoustic metamaterial muffler: acoustic and CFD approach." Engineering Research Express 3.3 (2021): 035027. Aug. 16, 2021. (pp. 1-25).

(Continued)

*Primary Examiner* — Jeremy A Luks
(74) *Attorney, Agent, or Firm* — NSIP Law

(57) ABSTRACT

The present disclosure provides an acoustic metamaterial-based muffler for exhaust noise reduction, including an exhaust flow body that is provided with an inlet through which exhaust gas of an internal combustion engine flows in on one side, and an outlet through which the exhaust gas flows out on the other side, and a flow passage for guiding a movement of the exhaust gas therein; and a plurality of noise reduction units that are sequentially disposed along a discharge direction of the exhaust gas inside the exhaust flow body to reduce noise in a specific frequency band in (Continued)

exhaust noise of the exhaust gas caused by the movement of the exhaust gas on the inside of the exhaust flow body.

16 Claims, 5 Drawing Sheets

(58) Field of Classification Search
USPC ..... 181/232, 247–251
See application file for complete search history.

(56) References Cited

U.S. PATENT DOCUMENTS 1,532,928 A * 4/1925 O'Connor ..... F01N 1/08 181/275
1,874,326 A * 8/1932 Mason ..... F01N 1/006 181/255
1,910,672 A * 5/1933 Bourne ..... F01N 1/02 381/353
1,924,605 A * 8/1933 Haas ..... F01N 1/083 181/247
2,075,088 A * 3/1937 Blanchard ..... F01N 13/007 181/247
2,075,265 A * 3/1937 Bourne ..... F16L 55/02 96/386
2,101,460 A * 12/1937 Schmidt ..... F01N 1/04 181/252
2,150,768 A * 3/1939 Holbrook ..... F01N 1/089 181/275
2,184,891 A * 12/1939 Bourne ..... F01N 1/02 181/273
2,213,614 A * 9/1940 Scarritt ..... F01N 13/18 181/255
2,233,804 A * 3/1941 Bourne ..... F16L 55/033 138/30
RE22,283 E * 3/1943 Bourne ..... F01N 1/04 181/248
2,326,612 A * 8/1943 Bourne ..... F01N 1/04 181/252
2,903,085 A * 9/1959 Miller ..... F01N 1/089 181/255
4,094,644 A * 6/1978 Wagner ..... F01N 1/08 422/181
7,600,607 B2 * 10/2009 Sullivan ..... H10N 10/13 181/278
7,905,319 B2 * 3/2011 Sullivan ..... F01N 1/086 181/232
8,210,309 B1 * 7/2012 Schlosser ..... F01N 1/026 181/227
10,167,756 B2 * 1/2019 Marquardt-Stammberger ..... G10K 11/172
2018/0080354 A1 * 3/2018 Smith ..... F01N 13/08
2020/0018204 A1 * 1/2020 Brockway ..... F01N 1/06

FOREIGN PATENT DOCUMENTS

KR 10-2009-0047083 A 5/2009
KR 10-2015-0095435 A 8/2015

OTHER PUBLICATIONS

Korean Office Action issued on Mar. 17, 2026, in counterpart Korean Patent Application No. 10-2022-0156857.

* cited by examiner

ACOUSTIC METAMATERIAL-BASED MUFFLER FOR EXHAUST NOISE REDUCTION

CROSS-REFERENCE TO RELATED APPLICATION

This application is based on and claims priority under 35 U.S.C. § 119 to Korean Patent Application No. 10-2022-0156857, filed on Nov. 22, 2022, in the Korean Intellectual Property Office, the disclosure of which is incorporated by reference herein in its entirety.

BACKGROUND

1. Field

The present disclosure relates to an acoustic metamaterial-based muffler for exhaust noise reduction, and more specifically, to an acoustic metamaterial-based muffler for exhaust noise reduction that reduces exhaust noise of an internal combustion engine by attenuating exhaust noise in a corresponding frequency band.

2. Description of the Related Art

In general, exhaust sound of a mechanical device powered by an internal combustion engine, such as a vehicle, is a source of noise in everyday life.

For the purpose of reducing exhaust noise generated from the power device of such an internal combustion engine, a muffler is used to reduce such noise.

Previously, many research results have been reported on noise reduction devices for engines with commercial vehicle-level displacement in many companies and organizations.

On the other hand, the development of an exhaust noise reduction device related to a mechanical device that uses a large internal combustion engine such as a large diesel generator and a combat vehicle as a power source is insufficient.

Most exhaust noise reduction devices for commercial vehicles on the market have complex internal structures, and a decrease in engine efficiency due to a pressure drop caused by the noise reduction device due to such a structure is inevitable.

In this case, the higher the displacement of the mechanical device, the more sensitive it is to the pressure drop due to the complex internal structure of the exhaust noise reduction device, and a larger diameter pipe size is required compared to that of a passenger vehicle.

The muffler of the passenger vehicle uses a pipe with a diameter of about 5 cm due to exhaust characteristics, and the high-displacement mechanical device using a large engine such as the generator and the combat vehicle requires a pipe several times larger than that of the passenger vehicle.

As the size of the pipe increases, the size of the muffler to be installed also increases, which may cause an installation space problem.

In addition, a size of an outer cylinder has to be small due to constraints related to installation space, and in this structure, it was difficult to implement a wide noise reduction band with a single unit structure.

The technology related to the exhaust noise reduction device is presented in Korea Unexamined Patent Publication No. 10-2013-0064299 (Jun. 18, 2013).

SUMMARY

An object of the present disclosure is to provide an acoustic metamaterial-based muffler for exhaust noise reduction that has a wide exhaust noise reduction band by attenuating exhaust noise in a corresponding frequency band without interfering with a flow of exhaust.

The present disclosure provides an acoustic metamaterial-based muffler for exhaust noise reduction, including an exhaust flow body that is provided with an inlet through which exhaust gas of an internal combustion engine flows in on one side, and an outlet through which the exhaust gas flows out on the other side, and a flow passage for guiding a movement of the exhaust gas therein; and a plurality of noise reduction units that are sequentially disposed along a discharge direction of the exhaust gas inside the exhaust flow body to reduce noise in a specific frequency band in exhaust noise of the exhaust gas caused by the movement of the exhaust gas on the inside of the exhaust flow body.

In addition, centers of the inlet and the outlet may be disposed to coincide based on a discharge direction of the exhaust gas.

In addition, the plurality of noise reduction units may reduce exhaust noise in the to 1500 Hz frequency band.

In addition, the noise reduction units may include a first noise reduction unit that reduces exhaust noise in the 20 to 200 Hz frequency band, a second noise reduction unit that reduces exhaust noise in the 200 to 500 Hz frequency band, and a third noise reduction unit that reduces exhaust noise in the 500 to 1500 Hz frequency band.

In addition, the first noise reduction unit, the second noise reduction unit, and the third noise reduction unit may be sequentially disposed inside the exhaust flow body along the discharge direction of the exhaust gas.

In addition, at least one of the first noise reduction unit, the second noise reduction unit, and the third noise reduction unit may be provided.

In addition, the first noise reduction unit may include a first reduction chamber portion provided with a first reduction inlet on one side and a first reduction outlet on the other side, a first reduction inlet pipe provided on one side of the first reduction chamber portion to be connected to the first reduction inlet, and a first reduction outlet pipe provided on the other side of the first reduction chamber portion to be connected to the first reduction outlet, a diameter of the first reduction inlet pipe is greater than a diameter of the first reduction outlet pipe, and a partial area of the first reduction inlet pipe is disposed to surround a partial area of the first reduction outlet pipe based on the discharge direction of the exhaust gas.

In addition, centers of the inlet and the outlet of the exhaust flow body may be disposed to coincide based on the discharge direction of the exhaust gas, and centers of the first reduction inlet, the first reduction outlet, the first reduction inlet pipe, and the first reduction outlet pipe may be disposed to coincide with the centers of the inlet and the outlet.

In addition, a length of the partial area of the first reduction inlet pipe surrounding the partial area of the first reduction outlet pipe may be shorter than a length of the remaining area of the first reduction inlet pipe that does not surround the partial area of the first reduction outlet pipe.

In addition, the first noise reduction unit may include a first reduction chamber portion provided with a first reduction inlet on one side and a first reduction outlet on the other side, a first reduction inlet pipe provided on one side of the first reduction chamber portion to be connected to the first reduction inlet, a first reduction outlet pipe provided on the other side of the first reduction chamber portion to be connected to the first reduction outlet, a first inlet connection baffle plate provided at a rear end of the first reduction inlet pipe to be connected to the first reduction outlet, and a first outlet connection baffle plate provided at a tip of the first reduction outlet pipe based on the discharge direction of the exhaust gas so as to be disposed to face the first inlet connection baffle plate, and the rear end of the first reduction inlet pipe and the tip of the first reduction outlet pipe may be disposed to be spaced apart based on the discharge direction of the exhaust gas.

In addition, a diameter of the first reduction inlet pipe may be the same as a diameter of the first reduction outlet pipe, and an outer diameter of the first inlet connection baffle plate may be larger than an outer diameter of the second outlet connection baffle plate.

In addition, the centers of the inlet and the outlet of the exhaust flow body may be disposed to coincide based on the discharge direction of the exhaust gas, centers of the first reduction inlet, the first reduction outlet, the first reduction inlet pipe, and the first reduction outlet pipe may be disposed to coincide with the centers of the inlet and the outlet.

In addition, the second noise reduction unit may include a second reduction chamber portion provided with a second reduction inlet on one side and a second reduction outlet on the other side, a second reduction inlet pipe provided on one side of the second reduction chamber portion to be connected to the second reduction inlet, and a second reduction outlet pipe provided on the other side of the second reduction chamber portion to be connected to the second reduction outlet, a diameter of the second reduction inlet pipe may be smaller than a diameter of the second reduction outlet pipe, and a partial area of the second reduction inlet pipe may be disposed to surround a partial area of the second reduction outlet pipe based on the discharge direction of the exhaust gas.

In addition, the centers of the inlet and the outlet of the exhaust flow body may be disposed to coincide based on the discharge direction of the exhaust gas, and centers of the second reduction inlet, the second reduction outlet, the second reduction inlet pipe, and the second reduction outlet pipe may be disposed to coincide with the centers of the inlet and the outlet.

In addition, a length of the partial area of the second reduction inlet pipe surrounding the partial area of the second reduction outlet pipe may be longer than a length of the remaining area of the second reduction inlet pipe that does not surround the partial area of the second reduction outlet pipe.

In addition, the third noise reduction unit may include a third reduction chamber portion provided with a third reduction inlet on one side and a third reduction outlet on the other side, a third reduction inlet pipe provided on one side of the third reduction chamber portion to be connected to the third reduction inlet, and a third baffle portion provided on one side of the third reduction chamber portion.

In addition, the third baffle portion may include a horizontal pipe disposed to surround a partial area of the second reduction inlet pipe based on the discharge direction of the exhaust gas, and a baffle plate provided at a rear end of the horizontal pipe based on the discharge direction of the exhaust gas.

In addition, the centers of the inlet and the outlet of the exhaust flow body may be disposed to coincide based on the discharge direction of the exhaust gas, and centers of the third reduction inlet, the third reduction outlet, the third reduction inlet pipe, and the third baffle plate may be disposed to coincide with the centers of the inlet and the outlet.

The acoustic metamaterial-based muffler for exhaust noise reduction according to the present disclosure is configured such that a plurality of noise reduction units, which reduce exhaust noise in a specific frequency band, are disposed in a straight structure where the centers of the inlet through which the exhaust gas flows in and the outlet through which the exhaust gas flows out coincide, and exhaust noise in a specific frequency band is reduced without interfering with the flow of the exhaust gas flowing through each of the noise reduction units in the exhaust flow body, thereby providing a wide exhaust noise reduction band.

BRIEF DESCRIPTION OF THE DRAWINGS

The above and other aspects, features, and advantages of certain embodiments of the disclosure will be more apparent from the following description taken in conjunction with the accompanying drawings, in which.

DETAILED DESCRIPTION

Figure 1:
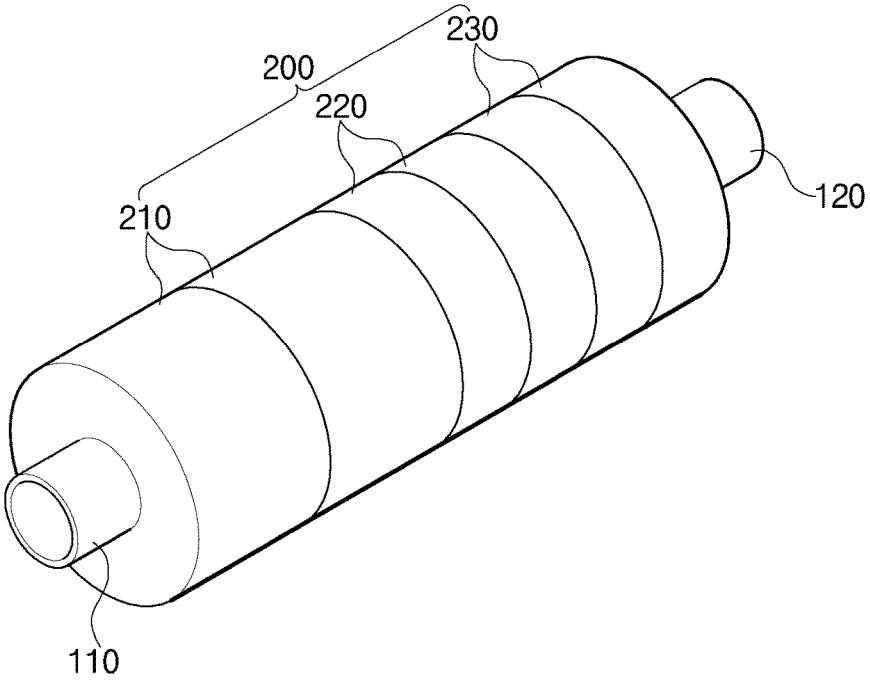
FIG. 1 is a perspective view illustrating an acoustic metamaterial-based muffler for exhaust noise reduction according to an embodiment of the present disclosure.

Hereinafter, preferred embodiments according to the present disclosure will be described in detail with reference to the attached drawings. Prior to this, the terms or words used in this specification and claims should not be construed as limited to their usual or dictionary meanings, and the present inventor should appropriately define the concept of terms in order to explain his invention in the best way. Based on the principle of definability, it must be interpreted with meaning and concept consistent with the technical idea of the present disclosure.

Therefore, the embodiments described in this specification and the configurations illustrated in the drawings are only the most preferred embodiments of the present disclosure, and do not represent the entire technical idea of the present disclosure, so it should be understood that at the time of filing this application, there may be equivalent variations that may be replaced.

First, a metamaterial is a material artificially designed to have unique properties that cannot be found in the natural world, and the metamaterial is composed of repeating arrangements of units.

Here, an acoustic metamaterial may control wave energy such as sound waves, and the acoustic properties of the acoustic metamaterial may be seen from a dispersion curve obtained through acoustic analysis of the units, and the band gap, which is a section where the wave number becomes an imaginary number, coincides with a noise reduction band.

In other words, the bandgap section becomes a frequency section where the transmitted noise is reduced compared to the incident noise when implementing the acoustic metamaterial by repeating the arrangement of the units.

The present disclosure rerates to an acoustic metamaterial-based muffler for exhaust noise reduction in which a plurality of noise reduction units that reduce exhaust noise in the corresponding frequency band are disposed in a straight structure where centers of an inlet through which exhaust gas flows in and an outlet through which exhaust gas flows out coincide, and a plurality of chambers forming the noise reduction unit reduce exhaust noise in the corresponding frequency band without interfering with the flow of exhaust gas flowing through an exhaust flow body 100.

Figure 2:
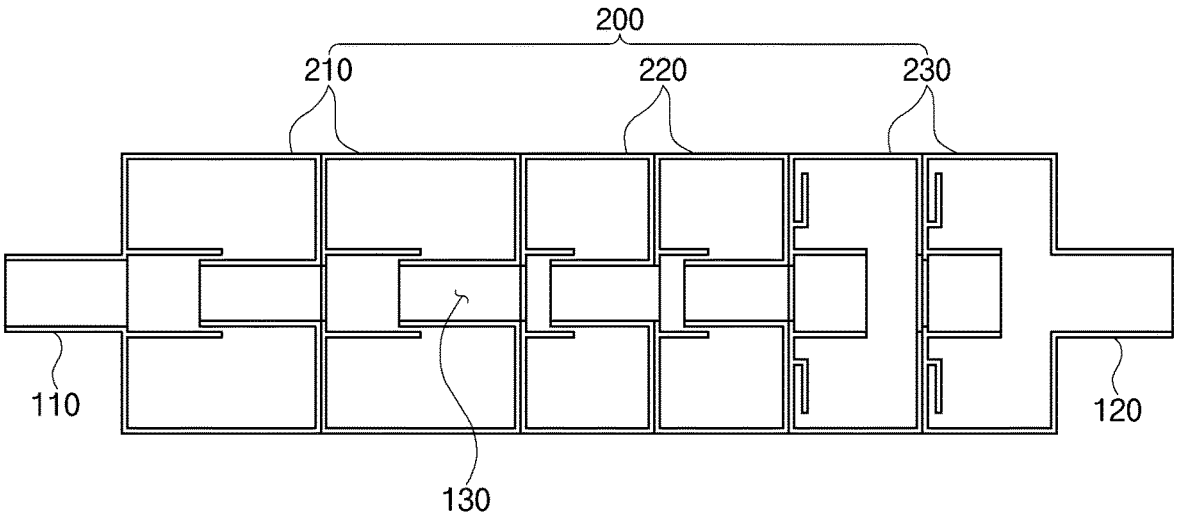
FIG. 2 is a sectional view illustrating an acoustic metamaterial-based muffler for exhaust noise reduction according to an embodiment of the present disclosure.

Referring to FIGS. 1 and 2, an acoustic metamaterial-based muffler for exhaust noise reduction according to an embodiment of the present disclosure may include the exhaust flow body 100 and a noise reduction unit 200. The acoustic metamaterial-based muffler for exhaust noise reduction of one embodiment is mounted on an exhaust pipe of an internal combustion engine (not illustrated) and allows exhaust gas generated in the internal combustion engine to flow in and then flow out again.

The exhaust flow body 100 may be provided with an inlet 110 through which exhaust gas of the internal combustion engine flows in on one side, and an outlet 120 through which the exhaust gas flows out on the other side opposite the inlet 110. Here, the centers of the inlet 110 and the outlet 120 are disposed to coincide based on a discharge direction of the exhaust gas, so that the exhaust flow of the exhaust gas may be stably achieved.

In addition, a flow passage 130 may be provided inside the exhaust flow body 100 to guide the exhaust flow so that the exhaust gas flowing in through the inlet 110 moves to the outlet 120.

Here, the exhaust flow body 100 is illustrated as having a straight pipe shape with a circular circumference, but is of course not limited thereto. Here, in addition, it is preferable that a diameter of the exhaust flow body 100 is larger than diameters of the inlet 110 and the outlet 120.

The noise reduction unit 200 is provided inside the exhaust flow body 100 and is a part that reduces exhaust noise caused when exhaust gas moves through the flow passage 130. A plurality of these noise reduction units 200 are sequentially provided inside the exhaust flow body 100 along the discharge direction of the exhaust gas to reduce noise in a specific frequency band in the exhaust noise of the exhaust gas caused by the exhaust gas moving along the flow passage 130 when being introduced into the inside of the exhaust flow body 100 through the inlet 110 and then discharged through the outlet 120. That is, the noise reduction unit 200 reduces exhaust noise caused when the exhaust gas moves along the flow passage 130 in the 20 to 1500 Hz frequency band.

The noise reduction unit 200 may include a first noise reduction unit 210, a second noise reduction unit 220, and a third noise reduction unit 230. In this case, the first noise reduction unit 210, the second noise reduction unit 220, and the third noise reduction unit 230 may be sequentially disposed along the discharge direction of the exhaust gas inside the exhaust flow body 100. In addition, at least one of the first noise reduction unit 210, the second noise reduction unit 220, and the third noise reduction unit 230 may be provided inside the exhaust flow body 100, and it is more preferable that each pair is sequentially disposed along the discharge direction of the exhaust gas.

Figure 3:
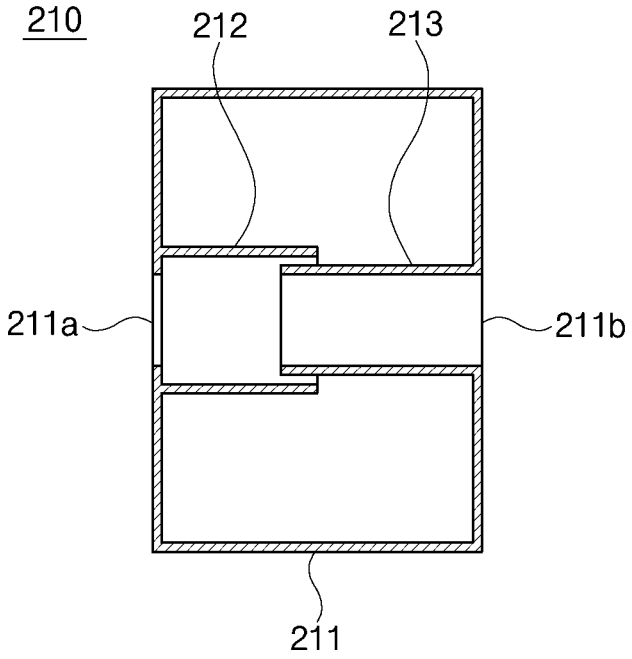
FIG. 3 is a sectional view of a first noise reduction unit illustrated in FIG. 2.

The first noise reduction unit 210 reduces the exhaust noise in the 20 to 200 Hz frequency band among the 20 to 1,500 Hz frequency range. Referring to FIG. 3, the first noise reduction unit 210 may include a first reduction chamber portion 211, a first reduction inlet pipe 212, and a first reduction outlet pipe 213.

The first reduction chamber portion 211 is a portion that provides a space to allow some of the exhaust gas that flows into the exhaust flow body 100 through the inlet 110 and then moves through the flow passage 130 to flow in. One side of the first reduction chamber portion 211 may be provided with a first reduction inlet 211*a* through which exhaust gas flows in, and the other side of the first reduction chamber portion 211 may be provided with a first reduction outlet 211*b* through which the exhaust gas flows out.

The first reduction inlet pipe 212 and the first reduction outlet pipe 213 are configured such that some of the flowing exhaust gas, which flows in through the first reduction inlet 211*a* and then flows out again through the first reduction outlet 211*b*, separately flows into the first reduction chamber portion 211.

Looking at this in detail, the first reduction inlet pipe 212 may be provided on one side of the first reduction chamber portion 211 to be connected to the first reduction inlet 211*a*, and the first reduction outlet pipe 213 may be provided on the other side of the first reduction chamber portion 211 to be connected to the first reduction outlet 211*b*.

In this case, a diameter of the first reduction inlet pipe 212 is greater than a diameter of the first reduction outlet pipe 213, and a partial area of the first reduction inlet pipe 212 may be disposed to surround a partial area of the first reduction outlet pipe 213 based on the discharge direction of the exhaust gas.

In addition, a length of the partial area of the first reduction inlet pipe 212 surrounding the partial area of the first reduction outlet pipe 213 may be shorter than a length of the remaining area of the first reduction inlet pipe 212 that does not surround the partial area of the first reduction outlet pipe 213.

Accordingly, some of the exhaust gas flowing through the first reduction inlet pipe 212 and the first reduction outlet pipe 213 flows into the first reduction chamber portion 211 through a space between the inside of the first reduction inlet pipe 212 and the outside of the first reduction outlet pipe 213. In this way, wave energy such as sound waves of the exhaust is incident into the first reduction chamber portion 211 through the inside of the first reduction inlet pipe 212 and the outside of the first reduction outlet pipe 213.

In addition, the centers of the first reduction inlet 211*a*, the first reduction outlet 211*b*, the first reduction inlet pipe 212, and the first reduction outlet pipe 213 of the first reduction chamber portion 211 are disposed to coincide with the centers of the inlet 110 and the outlet 120 of the exhaust flow body 100, so that the exhaust gas stably flows in the discharge direction.

In addition, an internal volume of the first reduction chamber portion 211 may be larger than volumes of the second reduction chamber portion 221 and the third reduction chamber portion 231 which will be described later.

Figure 4:
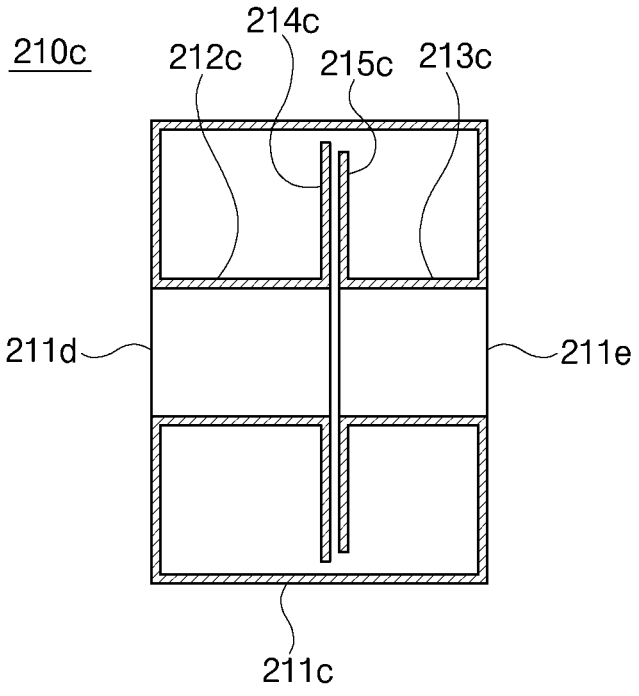
FIG. 4 is a sectional view according to another embodiment of the first noise reduction unit illustrated in FIG. 2.

Referring to FIG. 4, a first noise reduction unit 210*c* according to another embodiment may include a first reduction chamber portion 211*c*, a first reduction inlet pipe 212*c*, a first reduction outlet pipe 213*c*, and a first inlet connection baffle plate 214*c* and a first outlet connection baffle plate 215*c*.

Like the first reduction chamber portion 211 of the embodiment described above, the first reduction chamber portion 211*c* is a portion that provides a space to allow some of the exhaust gas, which flows into the exhaust flow body 100 through the inlet 110 and then moves through the flow passage 130, to flows in. One side of the first reduction chamber portion 211*c* may be provided with a first reduction inlet 211*d* through which the exhaust gas flows in, and the other side of the first reduction chamber portion 211*c* may be provided with a first reduction outlet 211*e* through which the exhaust gas flows out.

Looking at this in detail, the first reduction inlet pipe 212*c* may be provided on one side of the first reduction chamber portion 211*c* to be connected to the first reduction inlet 211*d*, and the first reduction outlet pipe 213*c* may be provided on the other side of the first reduction chamber portion 211*c* to be connected to the first reduction outlet 211*e*.

The first reduction inlet pipe 212*c* and the first reduction outlet pipe 213*c* are configured such that some of the exhaust gas, which flows in through the first reduction inlet 211*d* and then flows out again through the first reduction outlet 211*e*, separately flows into the first reduction chamber portion 211*c*.

That is, the rear end of the first reduction inlet pipe 212*c* and the tip of the first reduction outlet pipe 213*c* are disposed to be spaced apart at regular intervals based on the discharge direction of the exhaust gas, so that some of the exhaust gas separately flows into the first reduction chamber portion 211*c*.

In addition, the first inlet connection baffle plate 214*c* and the first outlet connection baffle plate 215 are configured such that some of the exhaust gas, which separately flows through a space between the first reduction inlet pipe 212*c* and the first reduction outlet pipe 213*c*, flows into the first reduction chamber portion 211*c*. In this case, wave energy such as sound waves of the exhaust is incident into the first reduction chamber portion 211*c* through the space between the first inlet connection baffle plate 214*c* and the first outlet connection baffle plate 215.

Here, the first inlet connection baffle plate 214*c* is provided at the rear end of the first reduction inlet pipe 212*c* based on the discharge direction of the exhaust gas. In this case, the first inlet connection baffle plate 214*c* may be provided around the first reduction inlet pipe 212*c* to extend perpendicular to a longitudinal direction of the first reduction inlet pipe 212*c*.

In addition, the first outlet connection baffle plate 215*c* is provided at a tip of the first reduction outlet pipe 213*c* based on the discharge direction of the exhaust gas. In this case, the first outlet connection baffle plate 215*c* extends perpendicular to the longitudinal direction of the first reduction outlet pipe 213*c*, and may be provided around the first reduction outlet pipe 213*c* to face the first inlet connection baffle plate 214*c*.

Here, a diameter of the first reduction inlet pipe 212*c* may be the same as a diameter of the first reduction outlet pipe 213*c*.

In addition, an outer diameter of the first inlet connection baffle plate 214*c* may be larger than an outer diameter of the second outlet connection baffle plate 215*c*.

In addition, the centers of the first reduction inlet 211*d*, the first reduction outlet 211*e*, the first reduction inlet pipe 212*c*, and the first reduction outlet pipe 213*c* of the first reduction chamber portion 211*c* are disposed to coincide with the centers of the inlet 110 and the outlet 120 of the exhaust flow body 100, so that the exhaust gas stably flows in the discharge direction.

Figure 5:
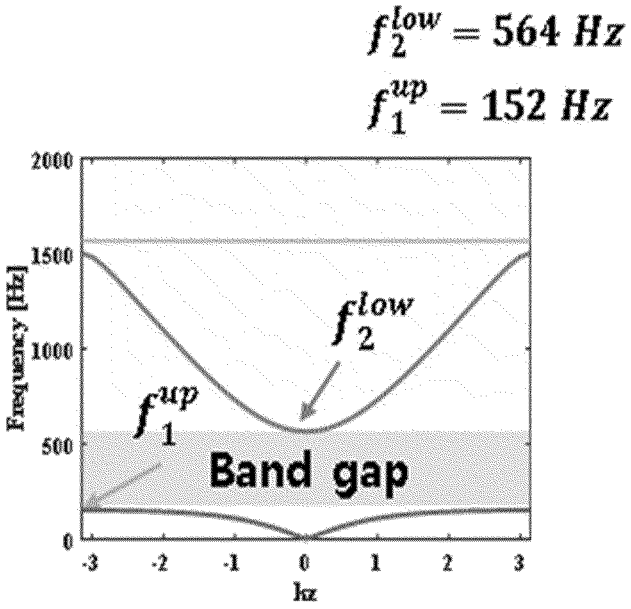
FIG. 5 is a graph illustrating analysis results of a band cap of the first noise reduction unit according to an embodiment of the present disclosure.

Referring to FIG. 5, it may be seen that the band gap section during the flow of the exhaust gas according to the first noise reduction units 210 and 210*c* mainly includes the to 200 Hz region, and the first noise reduction units 210 and 210*c* form a noise reduction band in the 20 to 200 Hz range in the frequency band of 20 to 1500 Hz, thereby reducing exhaust noise in that frequency band.

Figure 6:
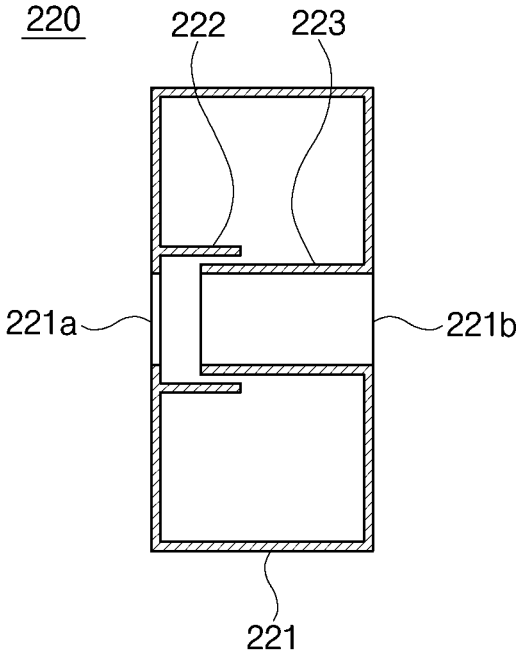
FIG. 6 is a sectional view of a second noise reduction unit illustrated in FIG. 2.

The second noise reduction unit 220 reduces exhaust noise in the 200 to 500 Hz frequency band among the 20 to 1,500 Hz frequency range. Referring to FIG. 6, the second noise reduction unit 220 may include a second reduction chamber portion 221, a second reduction inlet pipe 222, and a second reduction outlet pipe 223.

The second reduction chamber portion 221 is a portion that provides a space to allow some of the exhaust gas that flows into the exhaust flow body 100 through the inlet 110 and then moves through the flow passage 130, more specifically, the exhaust gas that passes through the first noise reduction units 210 and 210*c* to flow in. One side of the second reduction chamber portion 221 may be provided with a second reduction inlet 221*a* through which the exhaust gas flows in, and the other side of the second reduction chamber portion 221 may be provided with a second reduction outlet 221*b* through which the exhaust gas flows out.

The second reduction inlet pipe 222 and the second reduction outlet pipe 223 are configured such that some of the exhaust gas, which flows in through the second reduction inlet 221*a* and then flows out again through the second reduction outlet 221*b*, separately flows into the second reduction chamber portion 221.

Looking at this in detail, the second reduction inlet pipe 222 may be provided on one side of the second reduction chamber portion 221 to be connected to the second reduction inlet 221*a*, and the second reduction outlet pipe 223 may be provided on the other side of the second reduction chamber portion 221 to be connected to the second reduction outlet 221*b*.

In this case, the diameter of the second reduction inlet pipe 222 is smaller than a diameter of the second reduction outlet pipe 223, and a partial area of the second reduction inlet pipe 222 may be disposed to surround a partial area of the second reduction outlet pipe 223 based on the discharge direction of the exhaust gas.

In addition, a length of the partial area of the second reduction inlet pipe 222 surrounding the partial area of the second reduction outlet pipe 223 may be longer than a length of the remaining area of the second reduction inlet pipe 222 that does not surround the partial area of the second reduction outlet pipe 223.

Accordingly, the length of the moving flow of the exhaust gas is lengthened when some of the exhaust gas flowing through the second reduction inlet pipe 222 and the second reduction outlet pipe 223 flows into the second reduction chamber portion 221 through the space between the inside of the second reduction inlet pipe 222 and the outside of the second reduction outlet pipe 223. In this way, wave energy such as sound waves of the exhaust is incident into the second reduction chamber portion 211 through the space between the inside of the second reduction inlet pipe 222 and the outside of the second reduction outlet pipe 223.

In addition, the centers of the second reduction inlet 221*a*, the second reduction outlet 221*b*, the second reduction inlet pipe 222, and the second reduction outlet pipe 223 of the second reduction chamber portion 221 is disposed to coincide with the centers of the inlet 110 and outlet 120 of the exhaust flow body 100, so that the exhaust gas stably flows in the discharge direction.

Figure 7:
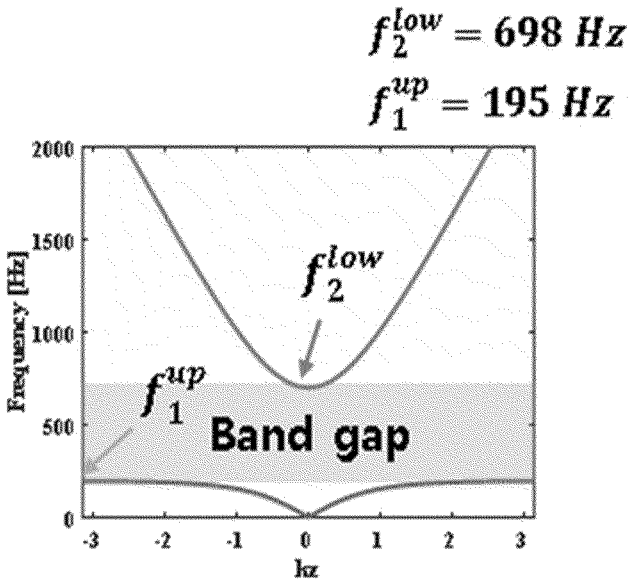
FIG. 7 is a graph illustrating analysis results of a band cap of the second noise reduction unit according to an embodiment of the present disclosure.

Referring to FIG. 7, it may be seen that the band gap section during the flow of the exhaust gas according to the second noise reduction unit 220 mainly includes the 200 to 500 Hz region and the second noise reduction unit 220 forms a noise reduction band of the range of 200 to 500 Hz among the frequency bands of the range of 20 to 1500 Hz, and thereby the exhaust noise in the corresponding frequency band is reduced.

Figure 8:
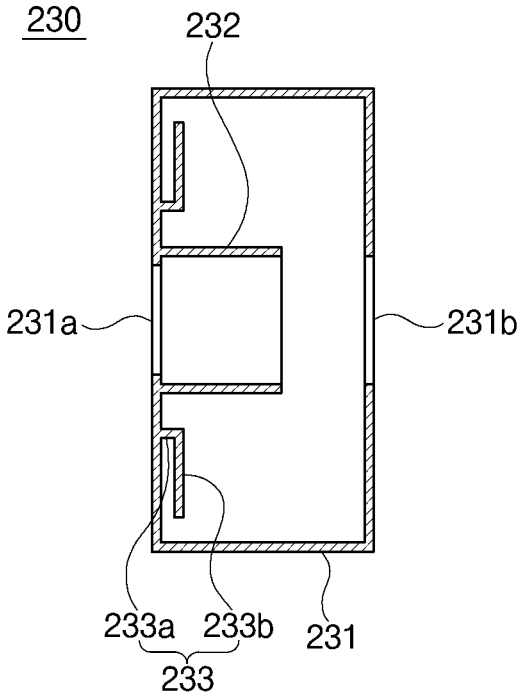
FIG. 8 is a sectional view of a third noise reduction unit illustrated in FIG. 2.

The third noise reduction unit 230 reduces the exhaust noise in the 500 to 1500 Hz frequency band among the frequency ranges of 20 to 1500 Hz. Referring to FIG. 8, the third noise reduction unit 230 may include a third reduction chamber portion 231, a third reduction inlet pipe 232, and a third baffle portion 233.

The third reduction chamber portion 231 is a portion that provides a space to allow the exhaust gas that flows into the exhaust flow body 100 through the inlet 110 and then moves through the flow passage 130, more specifically, the exhaust gas that passes through the second noise reduction unit 220 to flow in and then flow out again. One side of the third reduction chamber portion 231 may be provided with a third reduction inlet 231*a* through which the exhaust gas flows in, and the other side of the third reduction chamber portion 231 may be provided with a third reduction outlet 231*b* through which the exhaust gas flows out.

The third reduction inlet pipe 232 guides the exhaust gas discharged from the second noise reduction unit 220 to flow into the third reduction chamber portion 231.

In this case, the third reduction inlet pipe 232 may be provided on one side of the third reduction chamber portion 231 to be connected to the third reduction inlet 231*a*. Here, the tip of the third reduction inlet pipe 232 may be disposed to be closer to the third reduction outlet 231*b* than the third reduction inlet 231*a* based on the discharge direction of the exhaust gas.

The third baffle portion 233 reduces exhaust noise of the exhaust gas flowing into the third reduction chamber portion 231 through the third reduction inlet pipe 232. The third baffle portion 233 is provided on one side of the third reduction chamber portion 231 and may include a horizontal pipe 233*a* and a baffle plate 233*b*.

Here, the horizontal pipe 233*a* is a pipe member disposed to surround a partial area of the second reduction inlet pipe 222 based on the discharge direction of the exhaust gas. One end of the horizontal pipe 233*a*, that is, the tip of the horizontal pipe 233*a* may be provided to be connected to one side of the third reduction chamber portion 231 based on the discharge direction of the exhaust gas.

In addition, the baffle plate 233*b* is provided at a rear end of the horizontal pipe 233*b* based on the discharge direction of the exhaust gas. In this case, the baffle plate 233*b* may be provided around the horizontal pipe 233*a* to extend perpendicular to a longitudinal direction of the horizontal pipe 233*a*.

Accordingly, the flow of the exhaust gas flowing into the third reduction chamber portion 231 is caused between the inside of the horizontal pipe 233*a* of the third baffle portion 233 and the third reduction inlet pipe 232, and between the baffle plate 233*b* and one side of the third reduction chamber portion 231. In this case, wave energy such as sound waves of the exhaust is incident on through a space between the inside of the horizontal pipe 233*a* of the third baffle portion 233 and the third reduction inlet pipe 232 and between the baffle plate 233*b* and one side of the first reduction chamber portion 231.

In addition, centers of the third reduction inlet 231*a* and the third reduction outlet 231*b* of the third reduction chamber portion 231, the third reduction inlet pipe 232, and the horizontal pipe 233*a* of the third baffle portion 233 are disposed to coincide with the centers of the inlet 110 and the outlet 120 of the exhaust flow body 100, so that the exhaust gas stably flows in the discharge direction.

Figure 9:
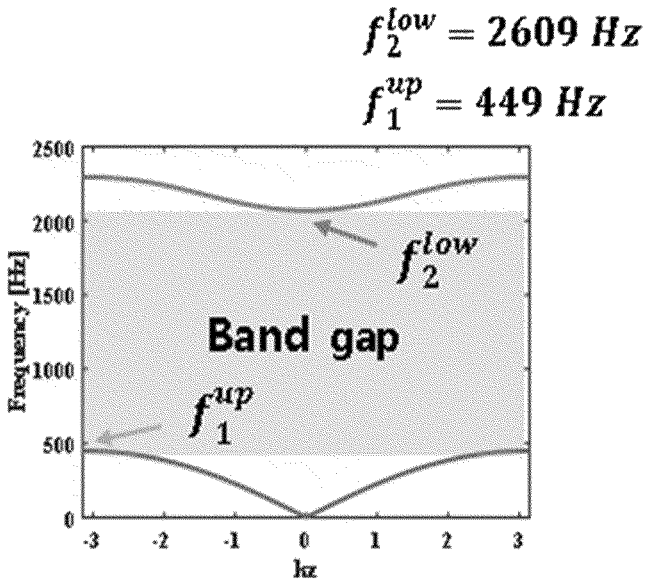
FIG. 9 is a graph illustrating analysis results of a band cap of the third noise reduction unit according to an embodiment of the present disclosure.

Referring to FIG. 9, it may be seen that the band gap section during the flow of the exhaust gas according to the third noise reduction unit 230 mainly includes the 500 to 1500 Hz region and the third noise reduction unit 230 forms a noise reduction band of the range of 500 to 1500 Hz among the frequency bands of the range of 20 to 1500 Hz, and thereby the exhaust noise in the corresponding frequency band is reduced.

Figure 10:
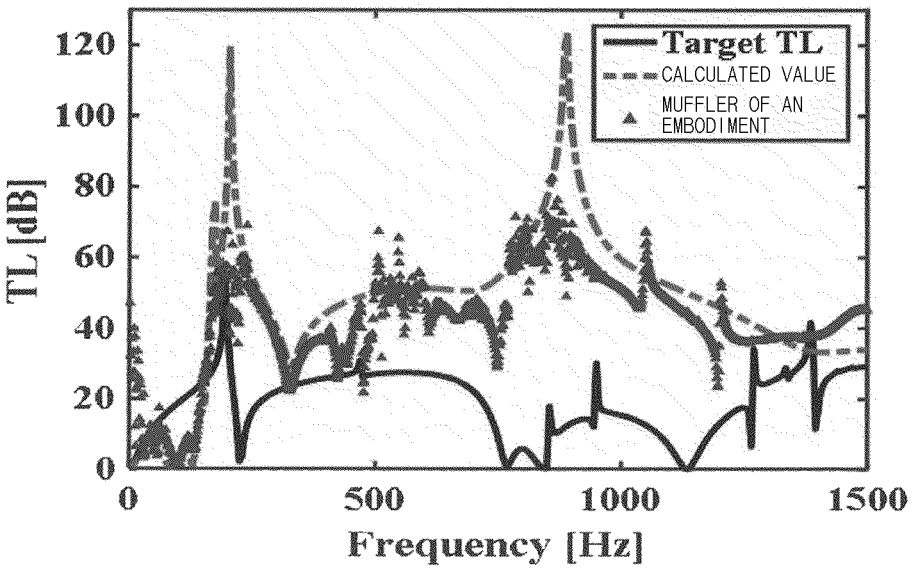
FIG. 10 is a graph illustrating a transmission loss curve obtained in a frequency band of 20 to 1500 Hz by an acoustic metamaterial-based muffler for exhaust noise reduction according to an embodiment of the present disclosure.

FIG. 10 is a graph illustrating a transmission loss curve obtained in the frequency band of 20 to 1500 Hz by an acoustic metamaterial-based muffler for exhaust noise reduction according to an embodiment of the present disclosure. Referring to FIG. 10, looking at the transmission loss curve actually obtained through experiments, it may be seen that high noise reduction performance was implemented in the 20~1500 Hz frequency band. Here, the calculated value is the transmission loss calculated based on finite element analysis.

In this way, the acoustic metamaterial-based muffler for exhaust noise reduction of an embodiment is configured such that a plurality of noise reduction units 200, which reduce exhaust noise in a specific frequency band, are disposed in a straight structure where the centers of the inlet 110 through which the exhaust gas flows in and the outlet 120 through which the exhaust gas flows out coincide, and exhaust noise in a specific frequency band is reduced without interfering with the flow of the exhaust gas flowing through each of the noise reduction units 200 in the exhaust flow body 100, thereby providing a wide exhaust noise reduction band.

The present disclosure has been described with reference to the embodiments illustrated in the drawings, but these are merely exemplary, and those skilled in the art will understand that various modifications and equivalent other embodiments are possible therefrom. Therefore, the true scope of technical protection of the present disclosure should be determined by the technical spirit of the attached claims.

SYMBOL LIST

100: exhaust flow body 110: inlet 120: outlet 130: flow passage 200: noise reduction unit 210: first noise reduction unit 211,211*c*: first reduction chamber portion 212,212*c*: first reduction inlet pipe 213,213*c*: first reduction outlet pipe 214*c*: first inlet connection baffle plate 215*c*: first outlet connection baffle plate 220: second noise reduction unit 221: second reduction chamber portion 222: second reduction inlet pipe 223: second reduction outlet pipe 230: third noise reduction unit 231: third reduction chamber portion 232: third reduction inlet pipe 233: third baffle portion 233*a*: horizontal pipe 233*b*: baffle plate

What is claimed is:

1. An acoustic metamaterial-based muffler for exhaust noise reduction, comprising:

an exhaust flow body that is provided with an inlet through which exhaust gas of an internal combustion engine flows in on one side, and an outlet through which the exhaust gas flows out on the other side, and a flow passage for guiding a movement of the exhaust gas therein; and a plurality of noise reduction units that are sequentially disposed along a discharge direction of the exhaust gas inside the exhaust flow body to reduce noise in a specific frequency band in exhaust noise of the exhaust gas caused by the movement of the exhaust gas on the inside of the exhaust flow body, wherein the noise reduction units comprise a first noise reduction unit, a second noise reduction unit, and a third noise reduction unit disposed sequentially from the inlet to the outlet inside the exhaust flow body along the discharge direction of the exhaust gas, wherein the first noise reduction unit comprises:

a first reduction chamber portion provided with a first reduction inlet on one side and a first reduction outlet on the other side;

a first reduction inlet pipe provided on one side of the first reduction chamber portion to be connected to the first reduction inlet; and a first reduction outlet pipe provided on the other side of the first reduction chamber portion to be connected to the first reduction outlet;

wherein the second noise reduction unit comprises:

a second reduction chamber portion provided with a second reduction inlet on one side and a second reduction outlet on the other side;

a second reduction inlet pipe provided on one side of the second reduction chamber portion to be connected to the second reduction inlet; and a second reduction outlet pipe provided on the other side of the second reduction chamber portion to be connected to the second reduction outlet, wherein the third noise reduction unit comprises:

a third reduction chamber portion provided with a third reduction inlet on one side and a third reduction outlet on the other side, a third reduction inlet pipe provided on one side of the third reduction chamber portion to be connected to the third reduction inlet, and wherein diameters of the first reduction inlet pipe, the second reduction inlet pipe, and the third reduction inlet pipe are same.

2. The acoustic metamaterial-based muffler for exhaust noise reduction according to claim 1, wherein centers of the inlet and the outlet are disposed to coincide based on a discharge direction of the exhaust gas.

3. The acoustic metamaterial-based muffler for exhaust noise reduction according to claim 1, wherein the plurality of noise reduction units reduce exhaust noise in the 20 to 1500 Hz frequency band.

4. The acoustic metamaterial-based muffler for exhaust noise reduction according to claim 1, wherein:

the first noise reduction unit reduces exhaust noise in the 20 to 200 Hz frequency band;

the second noise reduction unit reduces exhaust noise in the 200 to 500 Hz frequency band; and the third noise reduction unit reduces exhaust noise in the 500 to 1500 Hz frequency band.

5. The acoustic metamaterial-based muffler for exhaust noise reduction according to claim 4, wherein a diameter of the first reduction inlet pipe is greater than a diameter of the first reduction outlet pipe, and a partial area of the first reduction inlet pipe is disposed to surround a partial area of the first reduction outlet pipe based on the discharge direction of the exhaust gas.

6. The acoustic metamaterial-based muffler for exhaust noise reduction according to claim 1, wherein centers of the first reduction inlet, the first reduction outlet, the first reduction inlet pipe, and the first reduction outlet pipe are disposed to coincide with centers of the inlet and the outlet.

7. The acoustic metamaterial-based muffler for exhaust noise reduction according to claim 5, wherein a length of the partial area of the first reduction inlet pipe surrounding the partial area of the first reduction outlet pipe is shorter than a length of the remaining area of the first reduction inlet pipe that does not surround the partial area of the first reduction outlet pipe.

8. The acoustic metamaterial-based muffler for exhaust noise reduction according to claim 1, wherein the first noise reduction unit comprises:

a first inlet connection baffle plate provided at a rear end of the first reduction inlet pipe to be connected to the first reduction inlet pipe, and a first outlet connection baffle plate provided at a tip of the first reduction outlet pipe based on the discharge direction of the exhaust gas so as to be disposed to face the first inlet connection baffle plate, and the rear end of the first reduction inlet pipe and the tip of the first reduction outlet pipe are disposed to be spaced apart based on the discharge direction of the exhaust gas.

9. The acoustic metamaterial-based muffler for exhaust noise reduction according to claim 8, wherein a diameter of the first reduction inlet pipe is the same as a diameter of the first reduction outlet pipe, and an outer diameter of the first inlet connection baffle plate is larger than an outer diameter of the second outlet connection baffle plate.

10. The acoustic metamaterial-based muffler for exhaust noise reduction according to claim 8, wherein centers of the first reduction inlet, the first reduction outlet, the first reduction inlet pipe, and the first reduction outlet pipe are disposed to coincide with the centers of the inlet and the outlet.

11. The acoustic metamaterial-based muffler for exhaust noise reduction according to claim 1, wherein a diameter of the second reduction inlet pipe is smaller greater than a diameter of the second reduction outlet pipe, and a partial area of the second reduction inlet pipe is disposed to surround a partial area of the second reduction outlet pipe based on the discharge direction of the exhaust gas.

12. The acoustic metamaterial-based muffler for exhaust noise reduction according to claim 11, wherein centers of the second reduction inlet, the second reduction outlet, the second reduction inlet pipe, and the second reduction outlet pipe are disposed to coincide with the centers of the inlet and the outlet.

13. The acoustic metamaterial-based muffler for exhaust noise reduction according to claim 11, wherein a length of the partial area of the second reduction outlet pipe surrounded by the partial area of the second reduction inlet pipe is shorter than a length of the remaining area of the second reduction outlet pipe that is not surrounded by the partial area of the second reduction inlet pipe.

14. The acoustic metamaterial-based muffler for exhaust noise reduction according to claim 1, wherein the third noise reduction unit comprises a third baffle portion provided on one side of the third reduction chamber portion.

15. The acoustic metamaterial-based muffler for exhaust noise reduction according to claim 14, wherein the third baffle portion includes a horizontal pipe disposed to surround a partial area of the second reduction inlet pipe based on the discharge direction of the exhaust gas, and a baffle plate provided at a rear end of the horizontal pipe based on the discharge direction of the exhaust gas.

16. The acoustic metamaterial-based muffler for exhaust noise reduction according to claim 14, wherein centers of the third reduction inlet, the third reduction outlet, the third reduction inlet pipe, and the third baffle plate are disposed to coincide with the centers of the inlet and the outlet.

* * * * *